US006089933A

United States Patent [19]

Cotton

[11] Patent Number: 6,089,933

[45] **Date of Patent: *Jul. 18, 2000**

[54] BOUNDARY LAYER WATER PICKUP DEVICE

[76] Inventor: Richard Gene Cotton, 4511 Willowick Blvd., Alexandria, La. 71303

[ * ] Notice: This patent is subject to a terminal disclaimer.

[21] Appl. No.: 09/268,368

[22] Filed: Mar. 15, 1999

Related U.S. Application Data

[63] Continuation-in-part of application No. 08/918,067, Aug. 25, 1997, Pat. No. 5,890,939.

[51] Int. Cl.[7] ..... B63H 21/10

[52] U.S. Cl. ..... 440/88

[58] Field of Search ..... 114/198, 197, 114/183 R, 343, 255; 440/88

[56] References Cited

U.S. PATENT DOCUMENTS 835,854 11/1906 Franquist .
1,641,670 9/1927 French .
3,874,317 4/1975 Hikita .
3,878,807 4/1975 Reskusic et al. .
4,061,571 12/1977 Banner .
4,809,632 3/1989 Hamel .
5,165,358 11/1992 Fielder ..... 114/255
5,890,939 4/1999 Cotton ..... 440/88

*Primary Examiner*—Ed Swinehart
*Attorney, Agent, or Firm*—Garvey, Smith, Nehrbass & Doody, LLC

[57] ABSTRACT

A through-hull water pickup device for mounting in a watercraft below the water line where the layer of water next to the hull is known as the boundary layer. The device includes a flange having grooves that channel water into the watercraft via an open ended bore, at an amply low and fairly constant pressure or head and with low drag at varying speeds of the watercraft.

26 Claims, 4 Drawing Sheets

BOUNDARY LAYER WATER PICKUP DEVICE

CROSS-REFERENCE TO RELATED APPLICATIONS

This is a continuation-in-part of U.S. patent application Ser. No. 08/918,067, filed Aug. 25, 1997, entitled "Boundary Layer water Pickup Device", now U.S. Pat. No. 5,890,939 which is hereby incorporated herein by reference.

STATEMENT REGARDING FEDERALLY SPONSORED RESEARCH OR DEVELOPMENT

Not applicable

BACKGROUND OF THE INVENTION 1. Field of the Invention

This invention relates to water pickup devices for watercraft and more particularly, to a unique boundary layer water pickup device which includes a curved, grooved or slotted flange with a low profile fitted against the hull of a watercraft to take advantage of the relatively constant total head of the fluid boundary layer phenomenon. The through-hull device thus facilitates a flow of water through the device into the watercraft with an amply low and fairly constant total head or pressure and with low drag at various speeds of the watercraft.

2. General Background

Water pickup devices for channeling water into a watercraft for various purposes, including cooling the engine, providing water for line bait wells, boat wash down, marine toilets, desalinators, an auxiliary generator and other marine purposes, have long been known in the art. In the common "through hull" design, the water pickup device includes a curved flange or lip which is fitted to the hull below the waterline and a threaded nipple extends from the lip through the hull, where it receives a nut for securing the device in the hull. Water pickup using this device is adequate to a speed of about 40 mph, beyond which the device fails to provide water to the watercraft interior.

One of the problems which is inherent in the operation of other water pickup devices with "scoops" in watercraft, is that of wide pressure variation in the water pickup system. This pressure varies from zero when the watercraft is at rest, to sometimes undesirably high pressures as the watercraft gains speed. Since the pressure varies widely, adequate water supply in the watercraft at a suitable working pressure is unpredictable. These devices typically extend well below the profile of the watercraft hull to deflect water into the hull and the pressure of the water being deflected by the scoop varies with the speed of the watercraft over the water.

An early such water pickup device entitled "Valve" is detailed in U.S. Pat. No. 835,854, dated Nov. 13, 1906, to G. E. Franquist. The water pickup extends well below the plane of the bottom of the watercraft for scooping the water into a vertical chamber provided with a valve for controlling the flow of water into the watercraft.

U.S. Pat. No. 1,641,670, dated Sep. 6, 1927, to G. M. French, details an "Intake" which is mounted against the bottom of the watercraft and is fitted with parallel slots and an optional, downwardly-extending flute for scooping water and channeling the water into a conduit extending into the watercraft.

A "Cooling Water Intake Apparatus For Marine Vessels" is detailed in U.S. Pat. No. 3,874,317, dated Apr. 1, 1975, to Hikita. The device includes a tubular block which is adapted to be fitted into a through-hole provided in a watercraft hull, an intake pipe removably inserted in the tubular block and a strainer provided in the intake pipe for straining the water moving through the intake pipe. A valve is also provided on the tubular block to control the rate of flow of water through the apparatus.

U.S. Pat. No. 3,878,807, dated Apr. 22, 1975, to Reskusic et al, details a "Water Intake Strainer For Use On Boats" provided on a watercraft. The strainer includes an upward-tapering housing oriented in the normal direction of travel to expose a surface of desired profile for water pickup.

U.S. Pat. No. 4,061,571, dated Dec. 6, 1977, to Philip M. Banner, details a "Marine Water Inlet Device" provided with adapters that attach to the inlet pipe and a signal apparatus that indicates when a clogging condition exists in the water circulation system of the watercraft.

U.S. Pat. No. 4,809,632, dated Mar. 7, 1989, to J. P. Hamel, details a "Bottom Scoop For Engine Cooling Water". The device includes an outer body portion secured to the outside surface of the hull of a watercraft and an inner body portion is removably disposed in the outer body portion. The inner body portion has openings in one end that admit water into a cavity in the inner body, from which cavity the water flows to the cooling system of a marine power plant.

BRIEF SUMMARY OF THE INVENTION

It is an object of this invention to provide a unique, low profile water pickup device that utilizes fluid boundary layer phenomenon to channel water through the device at an amply low and fairly or suitably constant total head or pressure at varying speeds of the watercraft.

Another object of this invention is to provide a boundary layer water pickup device which has a low profile, grooved flange secured in the hull of the watercraft, to take advantage of the characteristics of the boundary layer and thus provide a flow of water with an adequately low and fairly constant total head or pressure through the device with low drag and at varying speeds of the watercraft.

Still another object of this invention is to provide a boundary layer water pickup device which is characterized by a unique "through-hull" fitting mounted in the hull of a watercraft below the waterline. The fitting has a continuous, curved flange or lip provided with an opening and at least one water pickup groove located in the direction of motion of the watercraft, to channel water from the boundary layer of the watercraft, through the groove or grooves and opening elements of the pickup device with an amply or adequately low and fairly constant total head or pressure and with low drag at various speeds of the watercraft through the water.

Those and other objects of the invention are provided in a unique boundary layer water pickup device having a continuous, flange or lip fitted with at least one, and preferably three, water pickup grooves having curved saddles and groove walls of dissimilar thickness, and a hollow, threaded nipple projecting from the flat base of the lip for extending through the flange and the hull of a watercraft.

The lip is positioned against the hull in the boundary layer of water flowing past the watercraft hull and the groove or grooves face the direction of motion of the watercraft, to provide a flow of water with a suitably low and fairly constant total head or pressure through the device at varying speeds of the watercraft.

An installation tool aligns the device with the watercraft longitudinal center line during tightening of the assembly nut to the external flanged fitting. The installation tool has projections that fit grooves on the flange.

BRIEF DESCRIPTION OF THE SEVERAL VIEWS OF THE DRAWINGS

The invention will be better understood by reference to the accompanying drawing, wherein.

DESCRIPTION OF THE PREFERRED EMBODIMENTS

Figure 1:
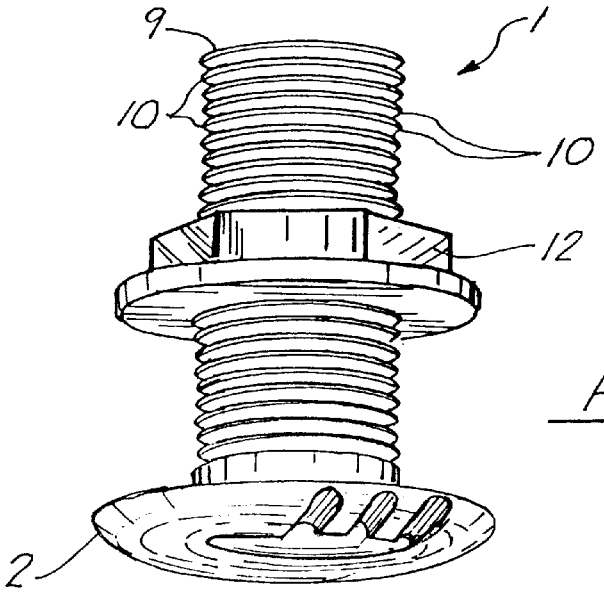
FIG. 1 is a perspective view of a preferred embodiment of the boundary layer water pickup device of this invention.

Referring initially to FIGS. 1–6 of the drawing, in a preferred embodiment the boundary layer water pickup device of this invention is generally illustrated by reference numeral 1. In this embodiment the flange 2 is round and includes a top-curved flange lip 3, having a flange outer surface at bottom 3*a*, and an inside surface 3*b* that can be shaped to define a concave flange cup. The outer surface 3*a* can be flat with a peripheral chamfer (see FIG. 7) or rounded in transverse cross section (see FIG. 8).

The flange lip 3 is fitted at outer surface 3*a* with three water pickup grooves 4, each preferably having a groove saddle 5. A thin groove wall 6 separates one of the two outer grooves 4 from the middle groove 4 and a thick groove wall 7 separates the opposite outer groove 4 from the middle groove 4, as illustrated. In a preferred embodiment the center groove 4 is oriented slightly off of a diameter of the flange 2, while the remaining outside grooves 4 are each positioned at a chord of the flange 2, as further illustrated in FIG. 2.

A nipple 9 extends from the flat side of the flange 2, opposite the flange lip 3. The nipple 9 is provided with nipple threads 10 for receiving a nut 12, in order to mount the boundary layer water pickup device 1, as hereinafter described. The nipple 9 is also fitted with an open ended nipple bore 11, which extends through the flange 2 and communicates with the grooves 4, as further illustrated in FIGS. 1 and 2.

Figure 2:
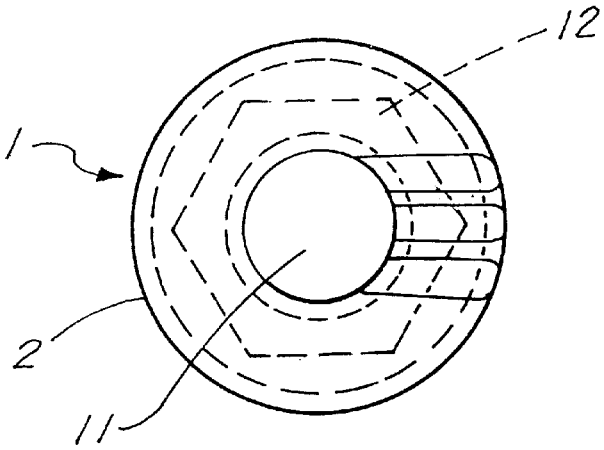
FIG. 2 is a bottom view of the boundary layer water pickup device illustrated in FIG. 1.
Figure 3:
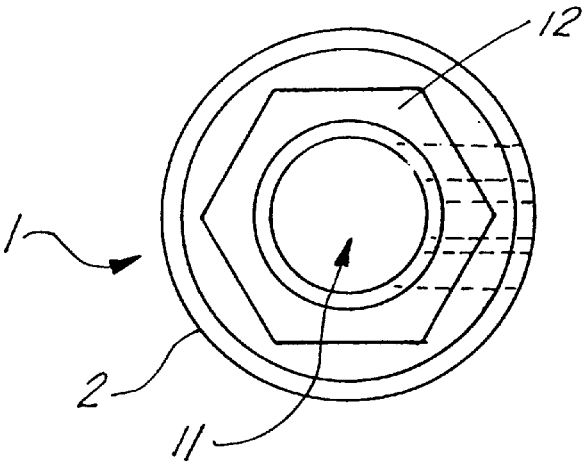
FIG. 3 is a top view of the boundary layer water pickup device illustrated in FIG. 1.

Referring now to FIGS. 1–3 of the drawing and particularly to FIG. 3, the boundary layer water pickup device 1 is mounted in the nipple opening 16 of the hull 15 below the waterline of a watercraft 14 by applying sealant to the flange inside surface 3*b* and to hull external surface 25 and then tightening the nut 12, as illustrated. Accordingly, when the boundary layer water pickup device 1 is mounted in this manner in the hull 15, the nipple bore 11 communicates with the interior hull surface 35 of the watercraft 14 and may be connected to an auxiliary water conduit for supplying water at a suitable pressure or head and with adequate quantities for marine engines, marine generators, marine air conditioning, marine toilets, desalinators, and salt water wash down, and like purchase well known to those skilled in the art. Furthermore, referring again to FIG. 3 of the drawings, the grooves 4 are positioned facing in the same direction as the direction of motion arrow 18, while water pressure is exerted on the respective grooves 4 in the direction of the water pressure arrow 19.

Figure 4:
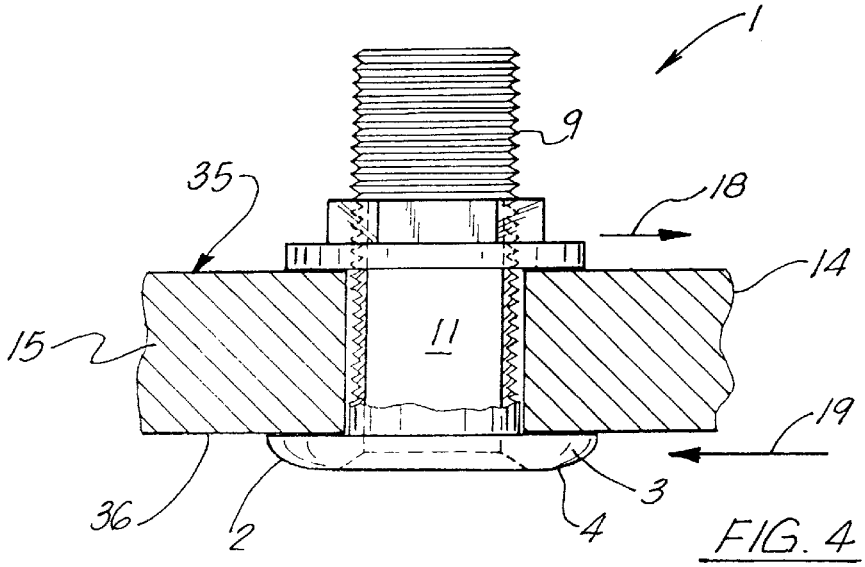
FIG. 4 is a sectional view of the boundary layer water pickup device illustrated in FIGS. 1 and 2, mounted in functional configuration in the hull of a watercraft, with the water pickup grooves oriented in the direction of travel of the watercraft.
Figure 5:
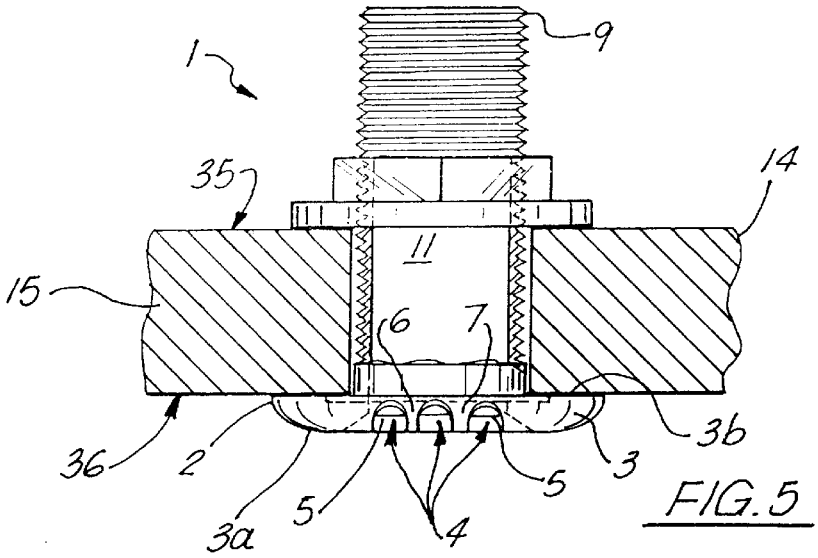
FIG. 5 is a sectional view of the boundary layer water pickup device mounted in the hull as illustrated in FIG. 3, with the grooves facing the viewer.
Figure 6:
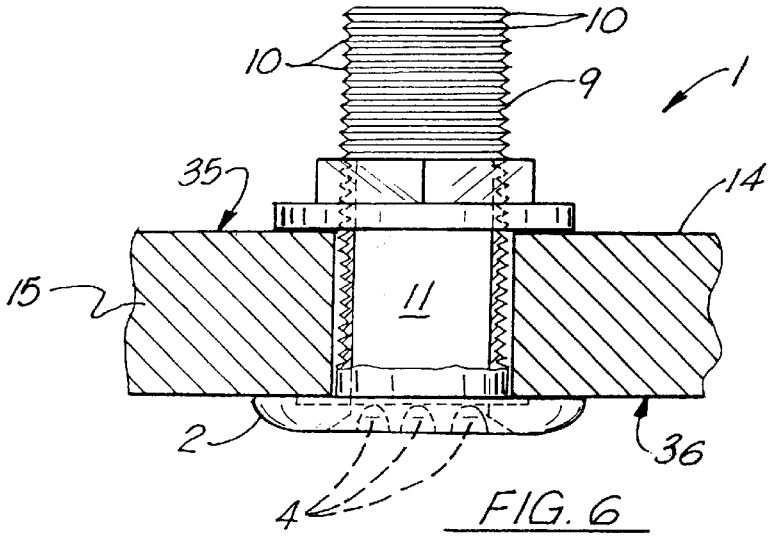
FIG. 6 is a sectional view of the boundary layer water pickup device illustrated in FIGS. 1 and 5 mounted in the hull of a watercraft, with the grooves disposed 180 degrees with respect to the groove orientation illustrated in FIG. 5.

Referring now to FIGS. 5 and 6 of the drawings, in FIG. 5, the grooves 4 are illustrated facing the viewer, while in FIG. 6 the grooves 4 face away from the viewer, to more particularly illustrate the facility for orienting the grooves 4 in any direction in a 360 degree circle in the hull 15 of the watercraft 14, to precisely and effectively position the grooves 4 in the direction of the direction of motion arrow 18, as illustrated in FIG. 4.

In operation, referring to the drawing (see FIGS. 7 and 8), it will be appreciated that when the watercraft 14 is at rest, a static head or pressure condition exists in the boundary layer water pickup device 1, allowing water to flow through the nipple bore 11 of the nipple 9 into the interior of the watercraft 14, as with a common through-hull design. However, as the watercraft 14 gains speed in the direction indicated by the direction of motion arrow 18 in FIG. 4, water pressure builds on the flange 2 in the direction indicated by the water pressure arrow 19.

Figures 7, 8, 9:
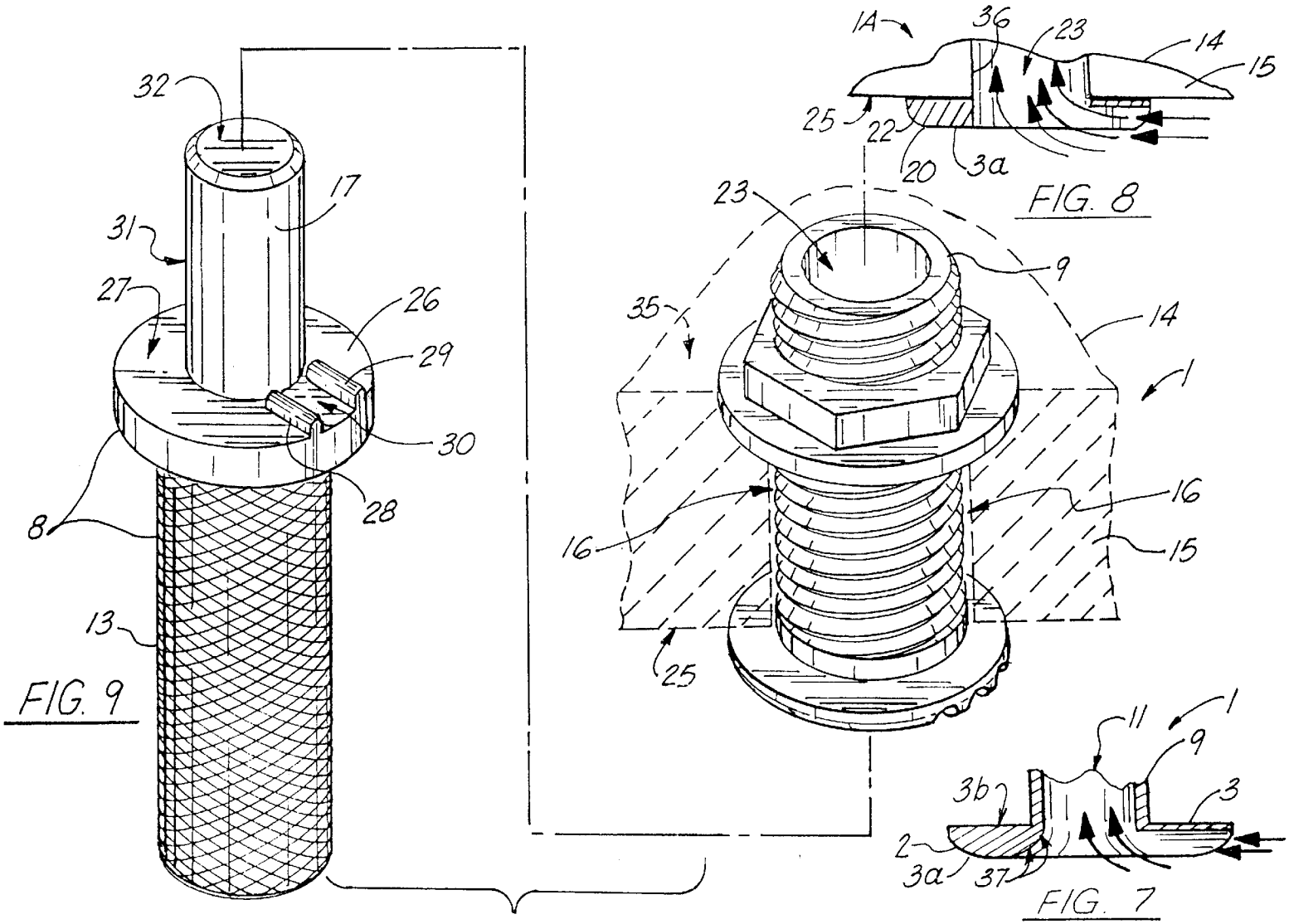
FIG. 7 is a fragmentary, sectional elevational view of the preferred embodiment of the apparatus of the present invention illustrating the lower end portion thereof.
FIG. 8 is a fragmentary, sectional, elevational view of an alternate embodiment of the apparatus of the present invention illustrating the lower end portion thereof.
FIG. 9 is a perspective view of the preferred embodiment of the apparatus of the present invention shown in operative position through the bottom of a boat hull and during installation using the installation tool portion of the apparatus of the present invention.
Figure 10:
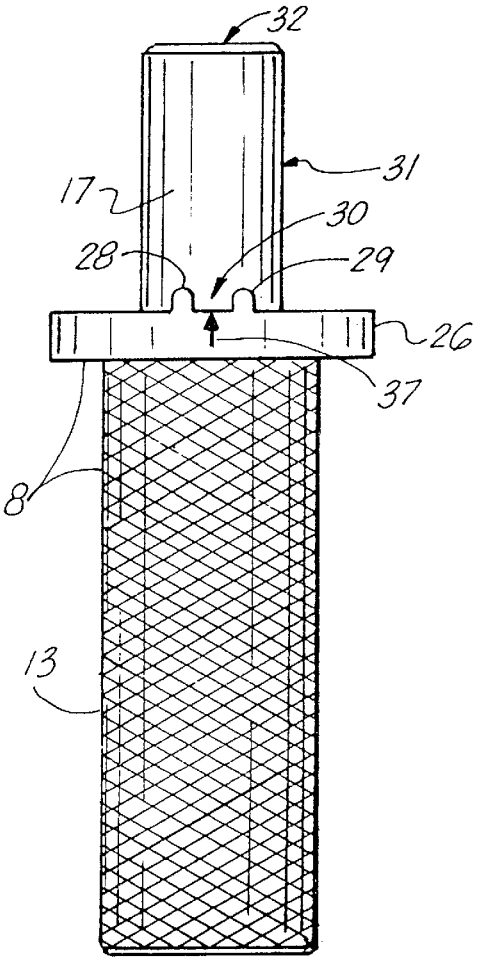
FIG. 10 is a front, elevational view of the installation tool portion of the preferred embodiment of the apparatus of the present invention.
Figure 12:
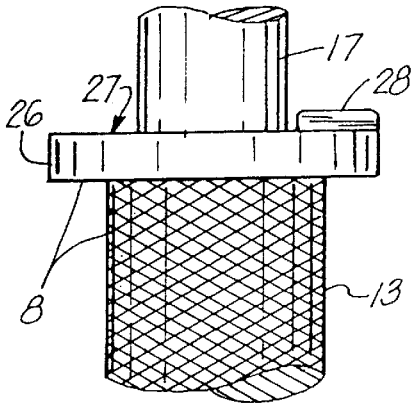
FIG. 12 is a partial, side elevational view of the installation tool of FIGS. 10 and 11.
Figure 13:
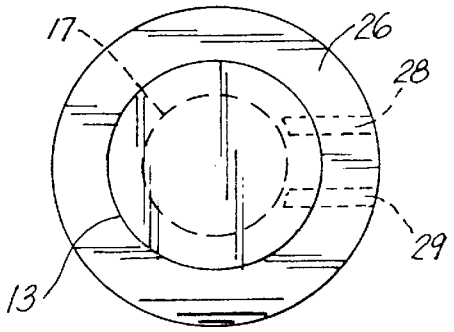
FIG. 13 is a bottom view of the installation tool of FIGS. 10, 11, 12.
Figure 11:
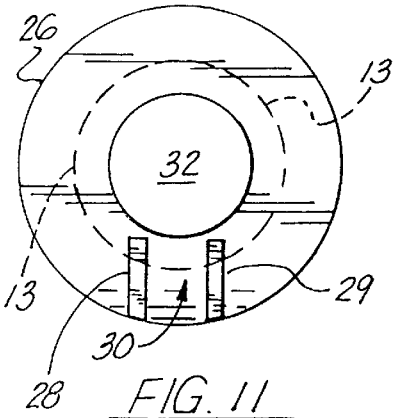
FIG. 11 is a top view of the installation tool of FIG. 10.

As the water flows over the curved groove saddles 5 in the respective grooves 4, it is caused to impinge upon that portion 36 of the interior of the nipple 9 and flange 2 located opposite the grooves 4 (see FIGS. 7 and 8. The disparity in thickness between the thin groove wall 6 and the thick groove wall 7, as well as the position of the middle groove 4 off-center with respect to a diameter of the nipple bore 11, and the location of the outside grooves 4 along a chord of the round flange 2, effect a spiraling action of the water through the nipple bore 11, into the interior of the watercraft 14. An increase in speed of the watercraft 14 effects a continuous flow of water through the grooves 4 and the nipple bore 11 without significantly changing the velocity head or pressure of the water flowing through the nipple bore 11. Accordingly, since the flange bottom 3*a* of the flange 2 is located snugly against the hull 15 of the watercraft 14 and the flange 2 is positioned in the boundary layer of water against the hull 15, it has been found that water continues to flow across the flange lip 3, through the grooves 4 in a continuous flow through the nipple bore 11 into the watercraft 14 at a head or pressure which is ample and adequate to service the auxiliary watercraft systems at a wide range of speed of the watercraft 14. In addition to this suitably constant head or pressure phenomenon in the water-hull boundary layer, the flange 2 offers a low profile to the flow of water and thus creates minimum drag on the hull 15 of the watercraft 14.

It will be appreciated by those skilled in the art that one or more grooves 4 of various size and/or shape may be provided in the flange lip 3 according to the teachings of this invention.

However, it has been found that three such grooves 4, using a thin groove wall 6 and a thick groove wall 7, and preferably having the curved groove saddles 5, are adequate and sufficient to take advantage of the relatively constant total head or pressure in the boundary layer of water against the hull 15 of the watercraft 14.

FIGS. 7 and 8 show the flow of water from a position in front of and below hull 15 into bore 11 of pickup device 1. In FIG. 7, the flange 3 has a curved outer surface 3*a* presented to the water surrounding the bottom 25 of hull 15. In FIGS. 7–8, the pickup fitting is designated as 1A and is configured at its lower end portion with a flat surface 3*a* rather than the curved surface 3*a* shown in FIGS. 4–6 and 7. In FIG. 8, the water pickup device 1A provides a lower most flange 2 attached to nipple 9. The flange 2 has a lower most flat surface 21 that communicates with cylindrically shaped bore 23 extending through both flange 20 and nipple 9 as well as communicating with a beveled annular surface or chamfer 22 that defines the periphery of flange 20.

In FIG. 9, an installation tool 8 is shown for use in combination with either water pickup device 1 or 1A. The installation tool 8 includes handle 13 that can provide an outer knurled or textured gripping surface. Above handle 13 is annular flange 26 having flat upper surface 27. A probe 17 portion extends upwardly from flange 26, the probe communicating with flat surface 27 and being surrounded by the flat surface 27 as shown in FIG. 9. The probe 17 is preferably cylindrically shaped, having a cylindrical outer surface 31 and a flat top surface 32. A pair of projections 28, 29 are generally parallel to one another and mounted upon flat annular surface 27.

Figure 14:
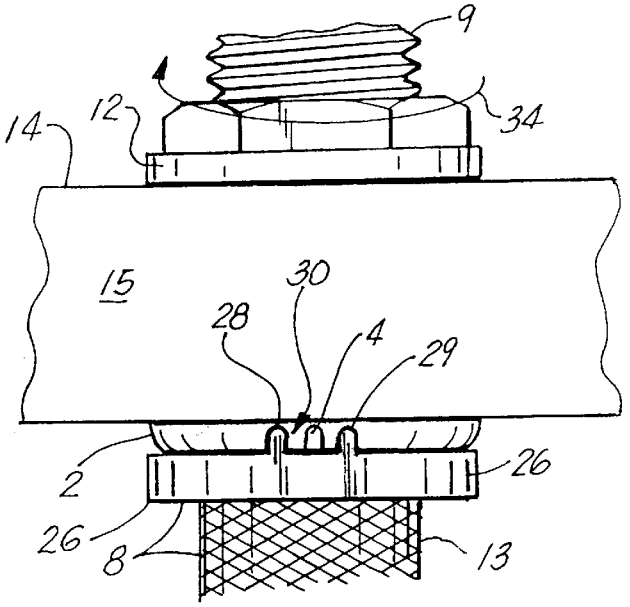
FIG. 14 is a side elevational view of the preferred embodiment of the apparatus of the present invention illustrating installation in a through hull opening and using the installation tool of the apparatus of the present invention.

The projections 28, 29 are placed in a position that enables them to interlock with and fit the two outer most grooves 4 of flange 2 or flange 20 as shown in FIG. 14. A space 30 is provided in between the projections 28, 29 for enabling the thin wall 6 and thick wall 7 to be fitted in between projections 28, 29 during installation as shown in FIG. 14.

Arrow 34 in FIG. 14 illustrates the rotation that can be applied to nut 12 in order to torque the nut 12 during installation through an opening 16 in hull 15. The user simply grips handle 13 and places the probe 17 into bore 11 or 23 of pickup device 1 or 1A at nipple 9. The cylindrically shaped probe 17 is preferably the same size and shape as the bore 11 or 23. The projections 28, 29 are placed into the two outermost grooves 4, as shown in FIG. 14. A socket wrench is then used to torque the nut 12 in the direction of arrow 34 so that the fitting 1 or 1A can be tightened with respect to the hull 15. The installation tool 8 enables the user to line up the grooves 4 with the longitudinal center line of the boats hull and its direction of travel so that the grooves 4 will be aligned with the boat's longitudinal center line and the direction of travel during use. An alignment mark or indicia (such as arrow 37) can be placed on flange 26 to indicate the proper location for projections 8, 29 and grooves 4 relative to the longitudinal center line of hull 15.

It will be further appreciated that the boundary layer water pickup device 1 can be utilized by all types of watercraft capable of higher speeds, including performance boats, yachts, pleasure boats, fishing boats, and jet skis, in non-exclusive particular.

While the preferred embodiments of the invention have been described above, it will be recognized and understood that various modifications may be made in the invention and the appended claims are intended to cover all such modifications which may fall within the scope and spirit of the invention.

PARTS LIST

| | |
|---|---|
| 1 | water pickup device |
| 1A | water pickup device |
| 2 | flange |
| 3 | curved flange lip |
| 3A | flange bottom |
| 3B | flange cup |
| 4 | groove |
| 5 | saddle |
| 6 | thin wall |
| 7 | thick wall |
| 8 | installation tool |
| 9 | nipple |
| 10 | threads |
| 11 | bore |
| 12 | nut |
| 13 | handle |
| 14 | watercraft |
| 15 | hull |
| 16 | opening |
| 17 | probe |
| 18 | arrow |
| 19 | arrow |
| 20 | flange |
| 21 | flat surface |
| 22 | beveled annular surface |
| 23 | bore |
| 25 | bottom of hull |
| 26 | annular flange |
| 27 | flat surface |
| 28 | projection |
| 29 | projection |
| 30 | space |
| 31 | cylindrical outer surface |
| 32 | flat top |
| 33 | flange curved surface |
| 34 | arrow |
| 35 | interior hull surface |
| 36 | inside |
| 37 | arrow |

Having described my invention with the particularity set forth above, what is claimed is:

1. A water pickup device for a watercraft, comprising:

a) a pickup body member that includes an annular flange having a flange opening said flange being positioned on the bottom of the watercraft during use;

b) the body having a nipple extending from said flange into the watercraft hull, said nipple having an open ended bore extending through said nipple and the flange opening;

c) at least one groove provided in said flange, said groove facing said opening in said nipple for providing water communication between said groove and said opening in said nipple at an amply low and fairly constant total head; and d) wherein at some point said groove is narrower than the diameter of said bore.

2. A water pickup device of claim 1 further comprising a curved saddle provided in said at least one groove for directing the water into said opening along said curved saddle.

3. The water pickup device of claim 1 wherein said at least one groove comprises a plurality of grooves that are separated by a groove wall.

4. The water pickup device of claim 3 comprising a curved saddle provided in each of the grooves for directing the water into said opening along said curved saddle.

5. The water pickup device of claim 1 wherein the flange is round and the groove is oriented off-center with respect to a diameter of said flange at said opening.

6. The water pickup device of claim 5 further comprising a curved saddle provided in the groove for directing the water into said opening along said curved saddle.

7. The water pickup device of claim 3 wherein there are a plurality of grooves that are separated by a thin groove wall and a thick groove wall.

8. The water pickup device of claim 5 wherein there are three grooves separated by a thin groove wall and a thick groove wall.

9. The water pickup device of claim 8 further comprising a curved saddle provided in each of said grooves for directing the water into said opening along said curved saddle.

10. The water pickup device of claim 1 further comprising threads provided on at least a portion of said nipple and a nut threaded on said threads for engaging the watercraft and securing said device on the watercraft.

11. The water pickup device of claim 10 comprising a curved saddle provided in said at least one groove means for directing the water into said opening along said curved saddle.

12. The water pickup device of claim 11 wherein there are three grooves, said grooves separated by a thin groove wall and a thick groove wall.

13. The water pickup device of claim 12 wherein said flange is round and said grooves are oriented off-center with respect to a diameter of said flange at said opening.

14. The water pickup device of claim 1 further comprising means for holding the flange so that its position can be aligned with the boat longitudinal centerline during installation.

15. A water pickup device for mounting in an opening in the hull of a watercraft for furnishing water to the watercraft at a relatively low and amply constant total head, comprising:

a) a fitting that includes a stem and a flange that is attached to the hull;

b) said flange having a diameter, and a thickness measured in a direction normal to the hull during use, said diameter being many times greater than said thickness, and the flange having a flange opening extending through the flange and into the stem;

c) at least one groove provided in said flange, said groove communicating with said flange opening;

d) a bore through said stem that is in fluid communication with the flange opening and that enables water to flow through said groove and said flange opening into the watercraft via the stem bore; and e) wherein said groove has a maximum width that is less than or equal to the diameter of said bore.

16. The water pickup device of claim 14 wherein the stem includes a threaded nipple extending from said flange into the watercraft, said nipple having a bore communicating with said flange opening for channeling water from said groove means into the watercraft.

17. The water pickup device of claim 14 comprising a curved saddle provided in said at least one groove means for directing the water into said opening along said curved saddle.

18. The water pickup device of claim 14 wherein said at least one groove means includes three grooves, said grooves separated by a thin groove wall and a thick groove wall.

19. The water pickup device of claim 15 wherein said at least one comprises three grooves, said grooves separated by a thin groove wall and a thick groove wall and comprising a curved saddle provided in each of said grooves for directing the water into said opening along said curved saddle.

20. The water pickup device of claim 14 wherein said flange is round and said groove is oriented off-center with respect to s diameter of said flange means at said opening.

21. The water pickup device of claim 19 wherein there are three grooves, said grooves separated by a thin groove wall and a thick groove wall.

22. The water pickup device of claim 20 comprising a curved saddle provided in each of said grooves for directing the water into said opening along said curved saddle.

23. The water pickup device of claim 21 wherein said holding means is a tool with a handle that supports a probe, the probe able to occupy the open ended bore, and wherein the tool has a projection that fits the groove.

24. A high speed, through hull water pickup fitting for marine vessels comprising:

a) a fitting member having an annular wall, a central bore, an upper end portion and a lower end portion;

b) the lower end portion of the fitting member having a diameter and a protruding portion that surrounds the bore, the bore being unobstructed at the lower end portion to maximize water intake and having an annular flange portion with a thickness that extends below the vessel hull and into the surrounding water during use when the vessel is on plane, said protruding portion having a periphery, and the diameter being much greater than the thickness;

c) a recess on the protruding portion that extends between the periphery of the protruding portion and the bore, the recess being of a generally uniform cross-section in a direction transverse to the boat travel and aligned generally with the direction of travel of the vessel during use;

d) a connector that affixes to the upper end portion of the fitting inboard of the vessel hull, holding the fitting in operating position that closely positions the protruding portion to the underside of the hull; and e) the recess and bore being configured to intake water when the vessel is at planning speed.

25. A method for installing a high speed water pickup fitting through the hull of a marine vessel with a planing hull comprising the steps of:

a) providing a fitting member having an annular wall, a central bore with an intake opening, said bore being unobstructed at the intake opening, an upper end portion and a lower end portion with a protruding flange portion that has a diameter and a thickness, said thickness measured generally normal to the hull during use;

b) forming an opening through the vessel hull that extends inboard and outboard of the hull;

c) positioning the protruding portion below the vessel hull and into the surrounding water, wherein the thickness of the protruding portion is much smaller than said diameter;

d) forming a groove on the protruding portion that extends between the periphery and the bore; and e) transmitting water inboard of the hull via the groove and then via the bore.

26. A high speed through hull water pickup fitting for marine vessels comprising:

a) a fitting member having an annular wall, a central open ended bore, an upper end portion and a lower end portion;

b) the lower end portion of the fitting member having a protruding flange portion with a thickness that extends the flange portion below the vessel hull and into the surrounding water during use, when the vessel is on plane, said protruding portion having a periphery and a diameter, the diameter being much greater than the thickness;

c) a recess on the protruding portion that extends between the periphery of the protruding flange portion and the bore, the recess being aligned generally with the direction of travel of the vessel during use;

d) a connector that affixes to the upper end portion of the fitting inboard of the vessel hull, holding the fitting in operating position that closely positions the protruding portion to the underside of the hull; and e) the recess and bore being configured to intake water when the vessel is at planning speed.

* * * * *